US007040230B2

(12) United States Patent
Hecht

(10) Patent No.: US 7,040,230 B2
(45) Date of Patent: May 9, 2006

(54) ACHIEVING AT LOW COST IMPROVED PRINT QUALITY AND HIGH GLOSS AND RECYCLABILITY ON PAPER OR PAPERBOARD SUBSTRATES ON SHEETFED OR WEBFED PRINTING PRESSES

(76) Inventor: Myer (Mike) Hecht, 1632 Sunneyside Ave., Highland Park, IL (US) 60035

( * ) Notice: Subject to any disclaimer, the term of this patent is extended or adjusted under 35 U.S.C. 154(b) by 150 days.

(21) Appl. No.: 10/901,317

(22) Filed: Jul. 28, 2004

(65) Prior Publication Data

US 2005/0034619 A1 Feb. 17, 2005

Related U.S. Application Data

(60) Provisional application No. 60/491,112, filed on Jul. 30, 2003.

(51) Int. Cl.
*B41F 7/04* (2006.01)
*B41F 23/00* (2006.01)
*B41F 23/08* (2006.01)

(52) U.S. Cl. ..... 101/483; 101/492; 427/428.01

(58) Field of Classification Search ..... 101/136, 101/137, 138, 141, 142, 450.1, 152, 177, 101/178, 181, 183, 216, 217, 219, 483, 492; 118/46; 427/211, 428.01, 428.07, 428.12, 427/288

See application file for complete search history.

(56) References Cited

U.S. PATENT DOCUMENTS 2,045,852 A * 6/1936 Hayward ..... 428/205
2,347,047 A * 4/1944 Gessler et al. ..... 427/372.2

(Continued)

FOREIGN PATENT DOCUMENTS

DE 3530561 A1 * 3/1987

*Primary Examiner*—Daniel J. Colilla
(74) *Attorney, Agent, or Firm*—Russell Hattis, Esq.

(57) ABSTRACT

A method of reducing the paper or paperboard costs to the owners of a press in the printing of ink on paper or paperboard substrates. The method including providing a press with one or more printing stations. Before feeding the substrates involved to an ink printing station on said press there is applied to said substrates a pore-sealing material to substantially eliminate any porosity thereof to enhance the print quality and gloss of a glossy water-based overprint coating. When on is applied thereto. Where a glossy coating is to be applied, it is applied after the substrates have been printed with ink by said press, and in a manner preferably to achieve 80–92 gloss. If a glossy coating is to be applied over portions of the inked substrates, a dull coating can be applied by the press over other portions of the substrates after all the ink has been applied and before the glossy coating is applied. To reduce the total cost of the equipment needed to produce a desired product having at least 3 colors, the printing press used preferably has at least 5 printing stations with one station before all of the ink-applying stations applying said pore-sealing material and one station after the last ink-applying station applying said glossy coating. Alternatively, if the printing press does not have enough stations to apply the pore-sealing material, the ink and the glossy coating in one pass through the press, the pore-sealing material can be applied to the substrate before said press is involved. Another aspect of the invention is to apply the pore-sealing material and the glossy coating using the multi-layered flexible body shown in U.S. Pat. No. 5,771,809. Finally, the substrates involved utilize a biodegradable paper or paperboard and all the inks and coatings applied thereto are biodegradable.

20 Claims, 5 Drawing Sheets

U.S. PATENT DOCUMENTS 3,218,183 A * 11/1965 Fritzsching et al. ..... 427/158
4,012,543 A * 3/1977 Ranger et al. ..... 427/361
4,898,752 A * 2/1990 Cavagna et al. ..... 427/265
5,630,363 A * 5/1997 Davis et al. ..... 101/141
5,638,752 A * 6/1997 Hartung et al. ..... 101/177
6,443,058 B1 * 9/2002 Stadler et al. ..... 101/23

* cited by examiner

ACHIEVING AT LOW COST IMPROVED PRINT QUALITY AND HIGH GLOSS AND RECYCLABILITY ON PAPER OR PAPERBOARD SUBSTRATES ON SHEETFED OR WEBFED PRINTING PRESSES

RELATED APPLICATION

This application claims the benefit of Provisional Application Ser. No. 60/491,112 filed Jul. 30, 2003.

BACKGROUND OF INVENTION

Offset lithography (offset or litho for short) is the most popular printing process. It is a printing process, typically with neither raised ink-printing surface segments on a printing plate, as in letterpress or flexography, nor recessed ink-printing segments, called cells, as in rotogravure.

Litho inks typically are oil-based, contain no water, have no or a small percent of volatile organic solvents, and have a paste consistency. Typically, litho inks are applied sequentially, one color at a time, from successive ink print stations. Typically, there are no dryers between print stations, so each color ink is still wet on the substrate, sheetfed or webfed, when the next layer of ink is deposited nearby or on it. This over-printing part of the process is called wet-trapping. Typically, a multi-color litho press has 5–10 print stations.

Typically, the conventional inks on sheetfed litho presses are still not dry when the sheets land on a delivery pile of the press, located after the last print station and connected thereto by an inclined ramp with a conveying mechanism therein. This is to say, there may be no drying equipment on-press before the delivery pile. Conventional litho inks dry and cure by a polymerization process in the delivery pile and thereafter, catalyzed by absorption of oxygen from the air. In other words, the drying and curing of conventional litho ink on sheetfed litho presses is a time-related affair. In contrast, flexo and gravure printing inks are quite fluid, typically contain large amounts of water or volatile organic solvents (VOCs), and have drying equipment after each print station to get rid of these volatiles. Thus, typically, flexo and gravure inks dry-trap (i.e. adhere to a dry surface on the substrate) at each print station, and there is no post-curing of the ink. And thus, typically flexo and gravure inks have a rather low amount of a film-forming material, in contrast to conventional litho inks which have a rather high amount of such material.

Another major difference between litho and the other three major printing processes is that litho uniquely deposits the ink indirectly onto the substrate. That is, the litho press has a printing plate, which does not deposit the ink thereon directly onto the substrate. The printing plate is carried on the surface of a rotating printing plate-carrying cylinder. The printing plate on this cylinder deposits the ink onto a layered rubber and fabric composite called a blanket carried on a rotating cylinder called a blanket cylinder. The blanket then deposits the ink onto the substrate. Hence, the derivation of the word offset to briefly describe the litho process. In contrast, the raised surfaces of letterpress and flexo printing plates and the recessed surfaces of gravure printing plates deposit the ink thereon directly onto the substrate.

This indirect transfer of ink from the litho printing plate to the substrate creates the need for an additional piece of equipment mounted adjacent to the printing plate-carrying cylinder called the dampener. The dampener applies a water and wetting agent mixture to the surface of the printing plate. There is an imaged portion on the printing plate surface which repels the water mixture and permits the litho ink to be deposited only upon the imaged surface thereon. The non-imaged areas of the printing plate with the water mixture thereon repel the litho ink and keep it off the substrate where it is not desired. There is thus no need for a dampener on the other three print process presses respectively which have only raised or recessed areas which receive the printing ink.

Also, because the litho ink is of paste consistency, many more what are herein called pressure rollers are required to transport the litho ink from its reservoir, called the ink fountain, onto the printing plate in the thin ink film needed for fidelity printing on the substrate.

In brief, litho is a much more complex printing process, but its typical production of better print fidelity on a wide variety of substrates has won its strong popularity. The sheetfed litho process is shown in detail in the drawings and is more fully described in the detailed description portion of this application.

All print processes have some drawbacks. One purpose of this invention is to show the litho printer, especially the modest family-owned sheetfed printer, how to overcome a major limitation, expense, and difficulty of applying gloss on paper, paperboard sheets or a web, and thus extend the capability of his existing equipment at modest capital expenditure. Also, the present invention provides print buyers with an environmentally-friendly, recyclable product, another advantage over the prior art.

Because there are many more sheetfed litho printers and presses than all other combined, with more people earning their livings in these plants, our drawings and discussion focus on sheets of paper or paperboard being printed on sheetfed litho presses. However, as above indicated, some of the principles involved in upgrading them also apply to webfed litho printing presses, especially in respect to sealing the somewhat porous print surfaces of the substrate to provide a better glossy, water-based overprint topcoat.

Many print buyers prize gloss on printed paper or paperboard, be it overall or selectively over portions of the printing. The attainment of high gloss generally commands a price premium because typically it is more costly to produce and typically requires more sophisticated and expensive production equipment than the typical modest family-owned printer has and can afford. Another purpose of this invention is to enable that modest family-owned printer to achieve high gloss at low cost in one pass through preferably existing, rather modest printing equipment already in his plant and which may not have coater equipment. Also, as previously indicated, it is preferable that the resulting product be environmentally-friendly and recyclable.

High gloss is typically defined as 80 minimum in the range of 80–92 on a 60° Glossmeter, a gloss-measuring instrument commercially available. Heretofore, high gloss is achieved in a sheetfed litho printing plant in one of two ways. One way uses a multi-color sheetfed litho printing press with or without an in-line overprint coater station, and an off-line ultra-violet (UV) light-generating and curing coating machine. This requires two passes of the sheets through the production equipment, and is another cost burden. The other way uses a multi-color sheetfed litho printing press with two in-line (meaning physically mounted on the press after the last print station) overprint coaters, a very expensive, sophisticated machine. The first of these coaters applies a water-based primer over the conventional litho ink, and the second of which applies a UV light-cured glossy topcoat over the primer. The function of the primer is to keep the still wet conventional litho inks away from the UV light-cured glossy topcoat, for these conventional inks poison the UV light-cured glossy topcoat and render it useless. These two coaters can add ¼ to ½ million dollars to the cost of a press, and typically the two coaters make the press run slower with more waste.

Virtually no conventional litho ink on paper or paperboard has a 60° gloss over 30. Many print buyers view this as a deficiency. So for fifty years or more, print buyers wanting higher gloss, specified X colors ink and a gloss-increasing varnish to be applied on the last print station of the litho press. The varnish is essentially a clear, unpigmented oil-based litho ink. Typically, it raised gloss levels 10–20 points to 40–50. As print buyers began to specify higher gloss than could be achieved with conventional litho ink and varnish, litho press manufacturers began to add a coater retractably mounted over the blanket cylinder of the last print station which applied the coating onto the blanket of the blanket cylinder. The blanket then applies the coating on to the substrate. Then still later, they physically mounted a coater, called the tower coater, on the press, positioned after the last print station. Said tower coater applies the coating directly onto the sheets after the sheets have left the last print station. The coater mounted over the blanket cylinder of the last print station is called a blanket coater. Either coater applies a rather fluid water-based emulsion, called a water-based coating, comprised of about 35–40% film-forming solids, formulated to wet-trap (i.e. capable of adhering to a wet litho ink surface) upon properly formulated conventional litho inks on the substrate. To dry these water-based overprint coatings (whatever their function) at or near rated press speed, the litho press manufacturer added a horizontal extended conveyor, after the tower coater and before the ramp, with its conveyor leading to the delivery pile. They equipped this extra space with drying equipment. Typically, the extra hardware added about $150,000 to $250,000 to the price of the press.

The coatings applied by either of these coaters of the prior art had various functions. These include: (1) to produce gloss; and/or (2) to increase scuff resistance; and or (3) to reduce or eliminate spray powder so as to provide a smoother product; and/or (4) to reduce the time needed for sheets to go to the next operation after they leave the press delivery pile, by preventing smudging of the still not fully dried ink.

Because these on-press applied fluid overprint water-based coatings contained only about 35–40% film-forming solids, the drying equipment after either coater had to get rid of 60–65% water, a difficult task at press speed. If the water was not eliminated, the coating was still wet and tacky and would cause sheets to stick together in the delivery pile; a phenomenon called blocking in the trade. Typically, these 35–40% solids water-based fluid overprint coatings when dry had a gloss in the range of 50–70, depending on coating formulation and the holdout character of the print surface of the paper or paperboard. This is a significant improvement in gloss compared to the aforementioned overprint varnish, and along with other attendant benefits, justified to many the cost of the extra equipment needed to attain this gloss level.

It is important to note that the fluid 35–40% solids water-based overprint glossy coatings do not have the necessary rheology to go through the many nips of the aforementioned multiple pressure rollers extending from the fountain. These fluid coating materials disintegrate in the third or fourth nip of these pressure rollers and can cause significant press damage.

To have the requisite rheology to go through the pressure rollers leading from the fountain to the printing plate on the plate cylinder without disintegrating, a glossy water-based coating needs about a 65% minimum solids content, 70% or higher preferred, along with a paste consistency. Such a coating deposited upon a typical paper or paperboard substrate by a planar-type printing plate typically does not produce gloss over 70. However, it does have the advantage of being able to be dried with suitable drying equipment in the standard delivery ramp at economic speeds because only 25–35% water needs to be eliminated from the substrate surface. However, such a coating can save the cost of a separate coater and an extended delivery.

What about the high-gloss minded print buyer who wanted his finished product to have gloss of 80 or higher. Nothing in the water-based coating prior art satisfied this buyer. As mentioned before, printers initially satisfied this buyer by installing the aforementioned special off-line (i.e., off-press) coating machines equipped with ultra-violet light producing lamps to cure the clear, transparent overprint coatings based on UV-curable chemistry. Typically, these UV-cured coatings were virtually 100% solids, contained no water, no VOCs, and cured almost instantaneously with proper energy output from the UV lamps. Depending on the absorbency, or the holdout of the printed surface they were deposited on, they produced 60° gloss in the range of 80–92. This is the derivation of the 80–92 level as the gloss target for printers to attain. The more competitive minded UV-curable printers focused on buying equipment which would permit them to attain the 80–92 gloss level in one-pass rather than the two-passes required with the off-line UV-curing coating machine. As previously explained, the second pass was eliminated by buying a litho press with two in-line coaters, but the cost of doing so was still too steep for the modest, family-owned printer. He needed a still lower cost method and hardware to attain the 80–92 gloss range.

Also, as previously indicated, the use of UV-cured coatings undesirably produced a product which is not recyclable.

SUMMARY OF INVENTION

The litho printer, practicing all the features of the press, most desirably utilizes a combination of factors to achieve 80–92 gloss at low cost on a litho press without UV-curable ink or coating, with conventional ink, preferably without an add-on auxiliary coater; preferably without an extended delivery; preferably with relatively porous paper or paperboard, and preferably in one pass through the press. At least one and preferably two or three of the print stations are used to apply other than ink to the substrate, namely a non-UV-curable, transparent varnish or other coating. The coating, if applied on the first print station before any ink is applied, is an underprint coating. The second such coating is applied on the last print station over the ink, usually to impart a gloss over at least a portion of the ink. Both coatings must obviously be applied in sufficient quantity to perform their respective different and separate functions. If the printer cannot spare two or more print stations to apply enough colors of ink the jobs require, he still can achieve the 80–92 gloss without UV-curable material, to ensure that the resultant product is biodegradable, by pre-applying the pore-covering litho varnish or water-based underprint coating in a separate pass through this press or other production equipment in his plant.

By providing better holdout to the overprint glossy topcoat, which maximizes the amount of glossy topcoat which remains on the print surface of the substrate, the 80 minimum gloss of the finished product can be achieved on relatively porous, cheaper, paper or paperboard. If the relatively non-porous, more costly paper or paperboard is used, the gloss of the finished product will be in the higher segment of the 80–92 range. Without the pore-covering coating applied on the first used print station before any ink is applied, it is difficult and maybe impossible to achieve the 80–92 gloss target without otherwise undesirable UV-curable coating, especially if the lower cost, relatively porous substrate is used. Thus, before this invention, printers did not think of using, or use, the first print station of a litho press to cover pores and seal the print surface to provide better holdout to inks and the high gloss overprint topcoat. As previously indicated, to seal the print surface a sufficient amount of the underprint pore-covering material must be applied to cover most or all of the pores of the substrate. A conventional, planar imaged printing plate (as shown in FIG. 1A of the drawings) cannot apply enough of this coating to do this. A "Mike Plate" or "Modified Mike Plate," as shown in FIG. 2A, is the lowest cost and most efficient way to do this. For example, on the popular 40" wide litho press, the "Mike Plate" material cost is less than $50.

Initially, a high solids, water-based pore-covering coating of about dyne level 38–44 was tried as the pore-covering material on the first print station. I found that without drying equipment between the first and second print stations, the oil-based litho inks could not wet-trap on a still somewhat wet water-based undercoat, and that the sheets stuck together in the delivery pile. Should more efficient dryers, which are not currently available, be developed, then water-based pore-covering coatings could be applied by the first print station without having to slow down the press.

Using an oil-based litho varnish, dyne level 38–44, with special film-forming ability, I found that litho inks could wet-trap upon the varnish, so the problem encountered with the water-based undercoat did not occur. Sheets with the special varnish undercoat, needing no dryer at the first used print station, four colors of printed ink, and the high gloss, water-based overprint coatings were in good condition when they were deposited on the delivery pile.

As previously mentioned, should the existing litho press of the modest, family-owned printer have only one station more than the number of colors he has to print, the printer can apply the pore-covering undercoat in a separate pass on this press before the application of any printing and overprint coating. Or, he can apply the pore-covering varnish or water based material undercoat on another sheetfed litho press. The latter can be a 1-color or 2-color printing press, or he can apply the pore-covering water-based undercoat on a prior, auxiliary piece of equipment such as a sheeter of a webfed coater equipped with suitable drying equipment. A sheeter is a machine, which cuts an unwinding roll of paper or paperboard into sheets of desired size.

Other considerations for achieving the most desired 80–92 gloss of the finished product are the following requirements for the inks: (a) a high ratio of ink pigment to binder—this enables achieving customer-specified densitometer reading at lowest ink weight and film thickness; (b) a low to zero VOC; (c) smooth transfer of litho ink through the pressure rollers extending from the ink fountain to the printing plate mounted on the plate cylinder; (d) dyne level 38 minimum, 40 or higher preferred.

The litho printer who has a multi-color sheetfed litho press with a blanket cylinder or tower coater can achieve 80–92 gloss on sheets of paper or paperboard by applying a pore-covering varnish or water-based pore-covering material via a "Mike Plate" or "Modified Mike Plate" on the plate cylinder of print station 1, printing conventional litho ink on subsequent print stations and applying a high gloss, fluid type water based coating of about 40% solids via a "Mike Plate" or "Modified Mike Plate" mounted on the blanket cylinder or tower coater.

In a nip between opposing rotating cylinders, not all of the liquid on the applying surface gets transferred to the receiving surface. Some remains on the applying surface. This is called the film-split. The nature of the liquid-applying surface determines how much of the liquid on it gets transferred to the receiving surface. Much transfer is desired. A "Mike Plate" or "Modified Mike Plate" applying surface inherently transfers more of the liquid on it onto a receiving surface in a nip than any other material employed to date.

DETAILED DESCRIPTION OF DRAWINGS

Figure 1A:
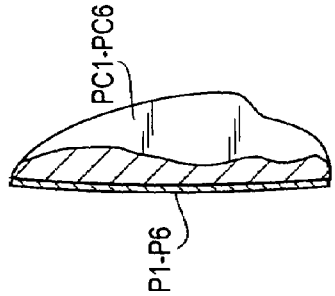
FIG. 1A PRIOR ART
FIG. 1A is a fragmentary, partial, sectional view showing the plate cylinder with a thin metal layer called the printing plate, or simply the plate, on the outer surface thereof. The plate is what receives the ink from the ink fountain, and subsequently transfers it.
Figure 1:
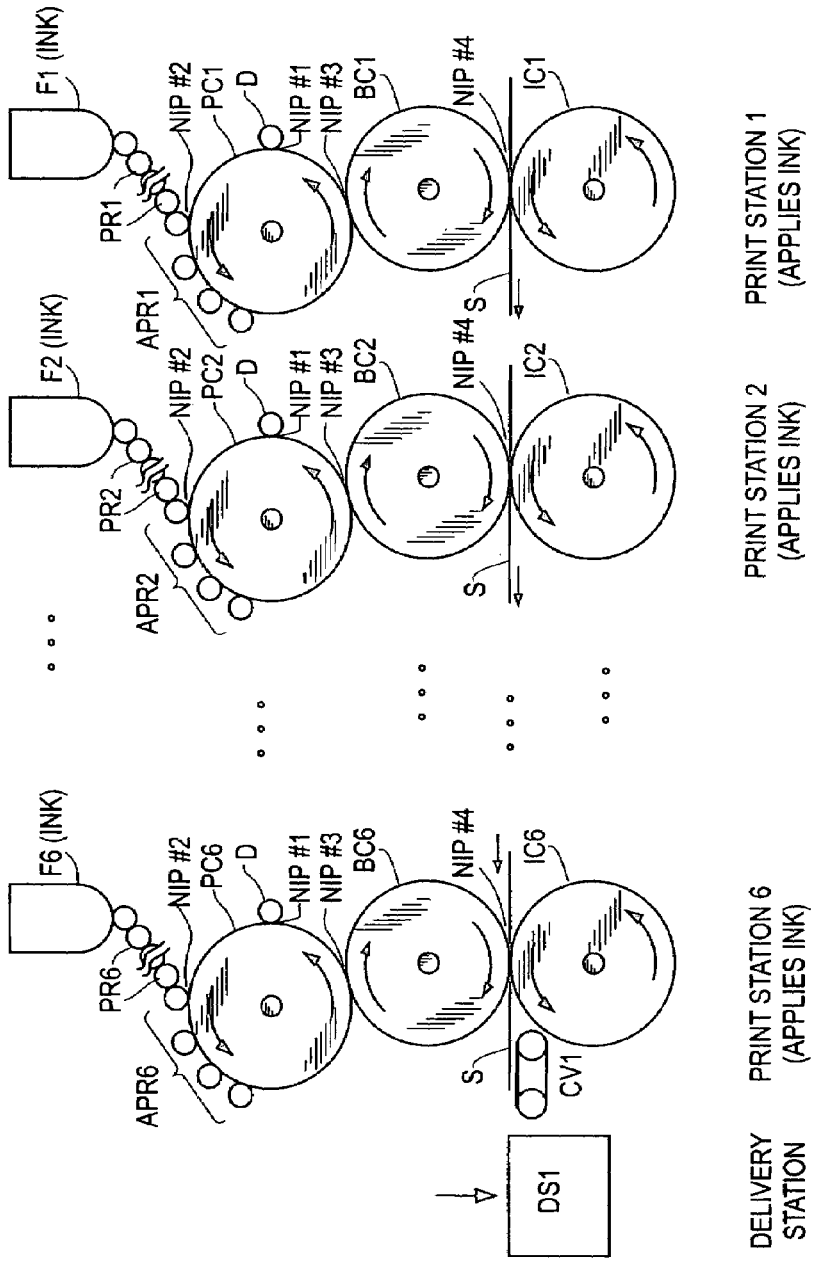
FIG. 1 PRIOR ART
FIG. 1 is an elevational view, partly broken away, showing the first, second and sixth print station of a six station prior art sheetfed printing press, wherein all stations print a different colored ink onto the substrate involved. Each station has an ink fountain, which holds a paste-type oil-based litho ink.

FIG. 1 representing the prior art shows six identical print stations of a sheetfed printing press, each with ink in all six ink fountains F1–F6, so that up to six colors of ink can be deposited onto the sheets. The ink fountains F1–F6 dispense ink to the surfaces of the litho printing plate mounted on the rotating plate cylinders PC1–PC6 through pressure rollers PR1–PR6 and ink applicator rollers APR1–APR6. The applicator rollers APR1–APR6 apply this ink in various nips #2 with what is mounted on the counter-clockwise-rotating plate cylinders PC1–PC6. Before what is mounted on the surfaces of these cylinders reaches the ink applicator rollers, a water-wetting agent mixture called the dampening solution is delivered thereto by conventional dampeners D at nips #1 thereat. On the surfaces of the printing plates mounted on the plate cylinders, are pre-selected imaged areas which repel the water-wetting agent mixture applied to the plates overall, so that the ink is retained only on the imaged areas. This ink is then transferred in nips #3 to the rubber-fabric composite called blankets mounted on the blanket cylinder BC1–BC6, shown rotating in a clockwise direction. These blankets then transfer the ink thereon onto the substrate sheets S in nips #4 with the adjacent impression cylinders, IC1–IC6, rotating counter-clockwise. All the plate cylinders in FIG. 1 are shown in section in FIG. 1A as having thin metal layers, called printing plates, secured to the outer surfaces thereof.

When a printed sheet S leaves the last print station 6, it drops upon a conveyor CV1 shown diagrammatically, which includes a ramp (not shown) inclining upward at an angle. The ramp has a set of chains on either side. The chains carry a set of metal bars, called gripper bars, with gripper fingers spaced thereon across its width. The fingers on the gripper bar grab the sheet, convey it up the ramp and across a delivery station DS1 where the sheets form a pile of sheets, one above the other. Before the fingers open to drop the sheet onto a skid on the delivery platform at the station, a device mounted thereabove sprays a powder called spray powder across the entire printed sheet. The purpose of the powder is to keep the bottom of the next sheet off the still wet ink below it, so the still wet and tacky ink will not smudge and some of it wind up on the bottom of the sheet above it. Also, the spray powder permits air to penetrate the pile so that the oxygen therein can get at the still wet ink and catalyze it so that it will polymerize, dry and cure, as explained in the background text.

This spray powder is a nuisance. It makes the finished product rough, which many press buyers don't like. It serves to abrade and smudge the ink in subsequent operations. It gets into the guts of the press and prematurely wears bearings, bushings, gears of the press, causing expensive maintenance repairs. The elimination of spray powder is one of the main reasons afterprint coatings which served only the purpose of keeping the top surface of the printer shell from sticking to the sheets below it.

Figure 2:
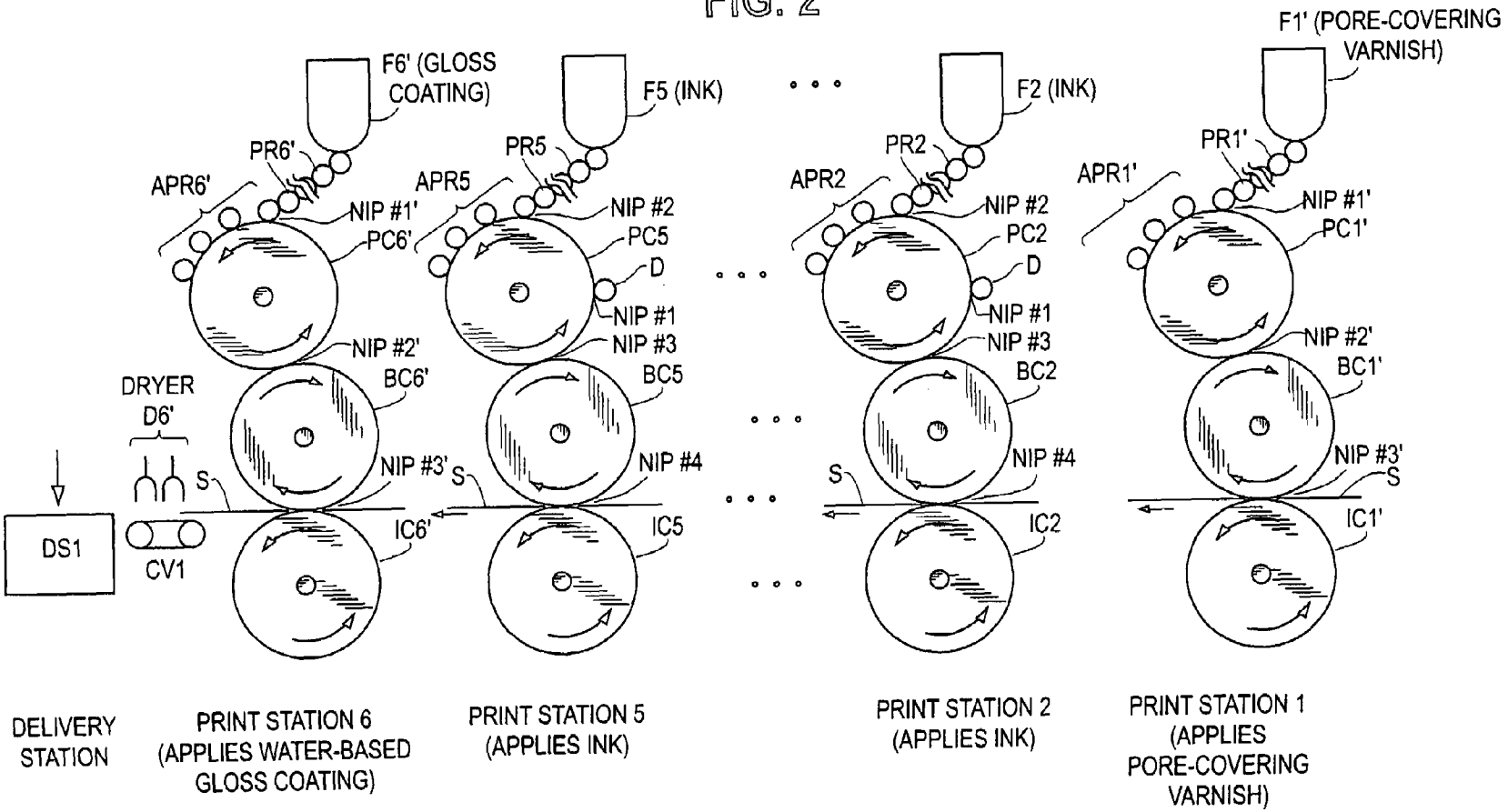
FIG. 2 shows one modification of the printing press shown in FIG. 1 where the press can only print a different colored ink on the second through the fifth print station. Unlike the press in FIG. 1, this press can print on very inexpensive, relatively porous paper and paperboard sheets because the first print station applies a pre-covering oil-based varnish, which is overprinted by the following ink-applying stations. Said pore-covering varnish covers and seals the pores, especially in the porous paper or paperboard. Further, wherein, the press also preferably applies on the sixth print station a transparent water-based coating over the ink to improve the intensity and appearance of said ink via higher gloss. The pore-covering oil-based varnish applied on print station 1 enhances the gloss of the water-based coating applied on station 6. It does this by enabling more of the water-based coating to reside atop what is underneath it.

In FIG. 2, which shows one form of the present invention, print stations 2–5 are shown which are identical to print stations 2–5 shown in FIG. 1, and thus have ink fountain receptacles F2–F5 which dispense four different colored inks. Print stations 1 and 6 of the embodiment of FIG. 2 differ from the print stations 2–5 of FIG. 2, which print four different ink colors. Print station 1 of FIG. 2 applies to the pressure roller PR1' a pore-covering oil-based litho varnish originating from the first fountain F1' and print station 6 thereof applies from the last fountain, F6' to the pressure rollers PR6' and applicating pressure rollers APR6' a high-solids, paste-consistency water-based gloss coating.

Said pore-covering oil-based litho varnish is a clear, transparent liquid, preferably with a 40 minimum dyne level. It is in the same family as the oil-based litho inks applied thereon, so no dryer is needed after the varnish deposition. The inks, which are applied thereon are formulated to wet-trap upon it. WIKOFF COLOR CORP., headquartered in Fort Mill, S.C., is the supplier of the pore-covering oil-based litho varnish I used. It is identified as V572. It is formulated to have superior film-forming ability, so it can bridge pores instead of sinking in. And, it is not dull.

When the paper or paperboard sheets leave the last print station 6 shown in FIG. 2, they are delivered by the same conveyor CV1 and other apparatus described in FIG. 1 to a delivery station, DS1. There is mounted over the sheets on conveyor C1 a suitable dryer D6', designed to dry the high-solids water-based gloss coating applied on print station 6.

As previously indicated, to maximize the effectiveness of the pore-covering litho varnish and the high-solids water-based glossy coating, the outer surfaces of the plate cylinders PC1' and PC6' most advantageously carry a "Mike Plate" as discussed in U.S. Pat. Nos. 5,771,809 and 6,044,761, or a modification thereof called a "Modified Mike Plate." Neither has been used before to apply a pore-covering, oil-based litho varnish on a plate cylinder of a litho or other printing press. One reason for this absence is heretofore nobody appreciated the value or need to apply a pore-covering liquid onto a printing press plate by any means. Apparently, nobody realized it could save paper costs or make the subsequent application of an overprint glossy coating more effective.

Figure 2B:
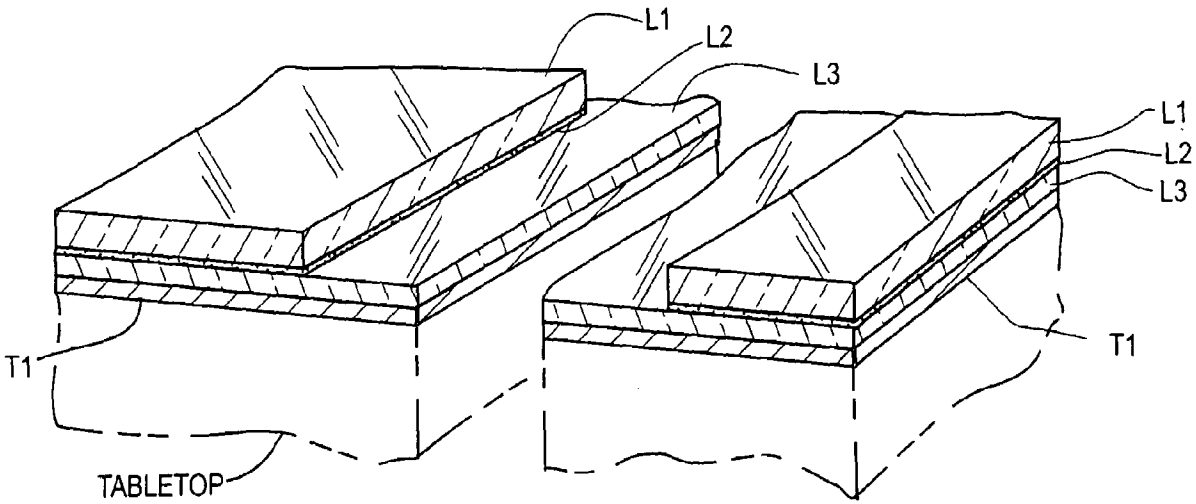
FIG. 2B is a fragmentary perspective view which shows the "Mike Plate" before it is attached to the periphery of the print cylinder of stations 1 and 6 of FIG. 2, where it is placed on a horizontal table above a template T1 visible through plate layers L1, L2, and L3, so that the outer layer, L1, can be cut to or near the surface of the lower layer L3, to form cut-away portions of the outer layer L1, which receives the varnish or coating. A "Modified Mike Plate" uses an imaged metal plate instead of the transparent plastic lower layer L3. It serves as its own template. It, too, is placed on a horizontal tabletop before the outer layer is attached thereto.
Figure 2A:
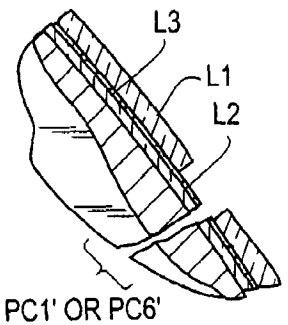
FIG. 2A shows a magnified fragmentary view in partial section of the most preferred form of printing plate cylinder used to apply said oil-based varnish and water-based glossy coating of print stations 1 and 6 respective of FIG. 2. Namely, one which uses the "Mike Plate" shown and claimed in U.S. Pat. Nos. 5,771,809 and 6,044,761, or what is called a "Modified Mike Plate," neither of which has been used heretofore on a printing plate to apply said varnish or coating.

As shown in FIG. 2A, a "Mike Plate" on the plate cylinders PC1' and PC6' each has a translucent applicator outer layer, L1, secured to a transparent inner layer, L3, called a carrier layer, by a thin adhesive middle layer, L2. Before being attached to the periphery of the plate cylinder, PC1' or PC6', the layers L1, L2, and L3, which are flexible, can be placed on a flat table shown in FIG. 2B over a template T1. This template has a cut pattern visible through the aforementioned three layers, so that a person with a knife can follow cut lines printed on the template to remove from the outer layer L1 areas thereof to leave only projecting portions which are to imprint upon the coating material. These areas could also be removed from the outer layer L1 with a programmable computer controlled machine with a cutting edge. This eliminates the need for a template. Also, the template would be unnecessary if the bottom layer L3 were opaque and had imprinted upon it the cut pattern desired. Such a multi-layered plate is the "Modified Mike Plate" previously referred to.

As previously indicated, the outer layer L1—the applicator layer—has the ability to transfer more of any liquid thereon than any other applicator. I have found that a 0.010" thick commercially available transparent polyester plastic, Mylar, to be the preferred carrier layer, L3, and a 0.020" thick commercially available translucent plastic sold under the trade name EZ-LAC with a sticker-back adhesive on it, are the preferred applicator and adhesive layers L1 and L2, respectively. I subsequently found that an imaged 0.008"–0.020" thick metal plate can replace the transparent Mylar carrier as Layer L3. As previously mentioned, it also obviates the need for a template.

The prior art did not apply glossy coating s from a fountain on a print station onto a "Mike Plate" or "Modified Mike Plate." When the prior art applied a glossy coating from the fountain of a print station, it was onto a prior art printing plate. The prior art printing plate less effectively transferred the glossy coating thereon eventually onto the substrate than said "Mike Plate" or "Modified Mike Plate" as previously indicated. This is because in the film split in a nip, the prior art deposits less of the glossy coating thereon eventually onto the substrate than the "Mike Plate" or "Modified Mike Plate." As previously indicated, the prior art used a "Mike Plate" or "Modified Mike Plate" to apply a relatively low solids content, rather thin fluid water-based glossy coating from a tower coater or blanket coater directly onto the substrate. Thus, no plate cylinder or fountain-feeding of same was involved. The relatively low solids content, rather thin fluid water-based coating these applied did not have the necessary rheology to go through the many nips of the rollers feeding the printing plate from the fountain without disintegrating.

Figure 3:
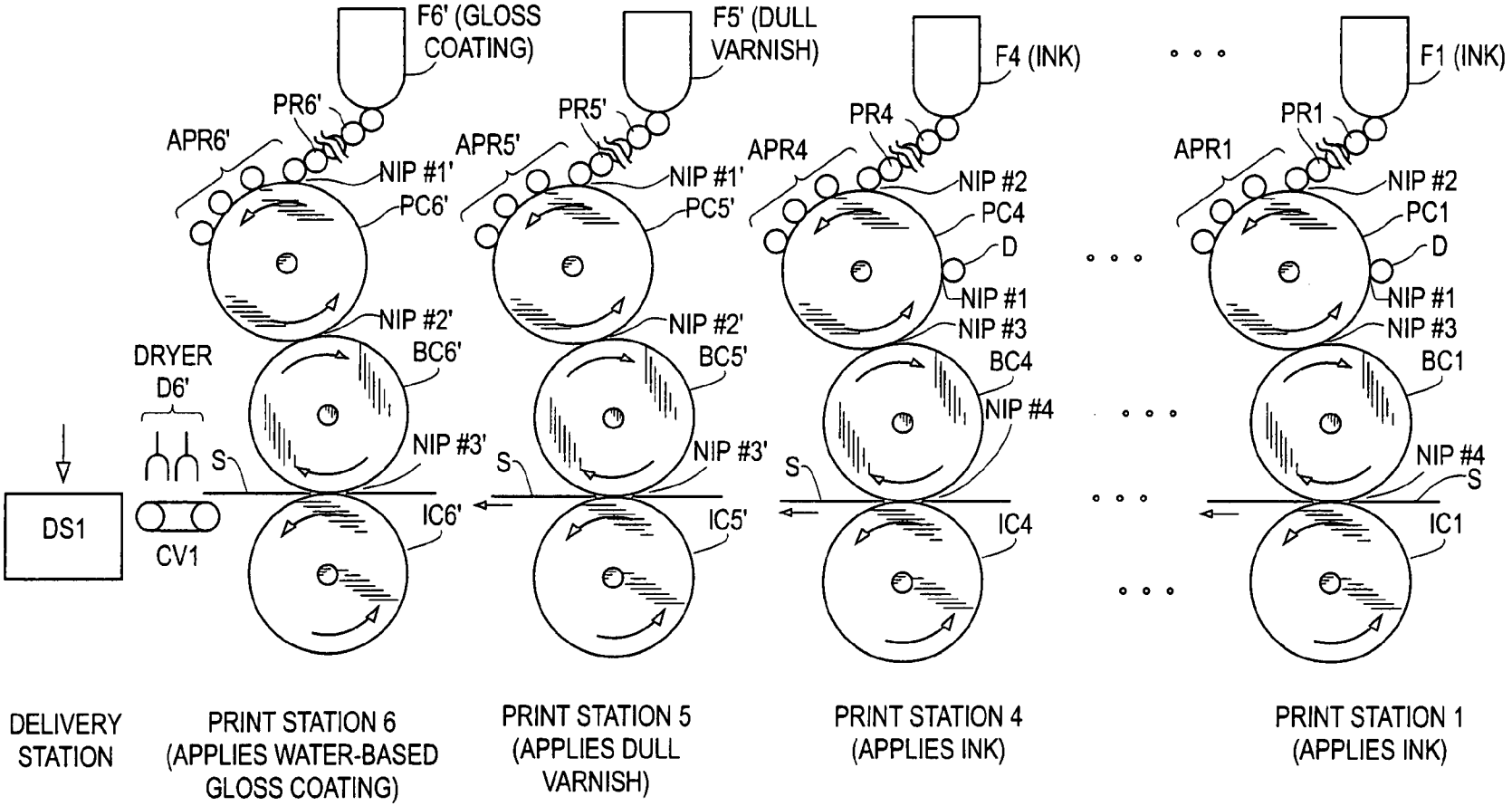
FIG. 3 shows a variation of the present invention where the first four print stations of the printing press are used to apply four colors of ink and the last two print stations are respectively used to apply a dull, transparent varnish and a high solids water-based gloss coating over different portions of the four ink colors printed on the press ahead of these stations. The resultant product is called a "highlight contrast" form.

Now refer to the embodiment of FIG. 3 which shows a variation of the present invention where the first four print stations of the printing press are used to apply four colors of ink and the last two print stations are respectively used to apply a dull oil-based litho varnish and a high-solids paste-consistency water-based gloss coating over different portions of the four ink colors printed on the press ahead of these stations. Accordingly, print stations 1–4 have identical ink-containing fountains F1–F4, associated pressure-applying rollers PR1–PR4, applicator rollers APR1–APR4, print cylinders PC1–PC4 and associated dampeners D, blankets and blanket cylinders BC1–BC4, and impression cylinders IC1–IC4. The press also has a last print stations 6 with said water-based, gloss coating-containing fountain F6', pressure-applying rollers PR6', applicator roller APR6', print cylinder PC6', and blankets and blanket cylinder BC6'. Following the last print station 6 is a dryer D6', conveyor CV1, delivery station DS1, and the other apparatus described in connection with FIG. 1. The FIG. 3 embodiment has a fifth station which, instead of applying ink onto the surface of a thin plate on the surface of a plate cylinder, instead applies a dull oil-based litho varnish onto a "Mike Plate" or "Modified Mike Plate" mounted thereon. The function of the dull varnish is to provide a contrast to the glossy overprint coating applied on print station 6 over portions of the ink applied by the first four print stations. The contrast, called "highlight contrast" in the trade, is esthetically pleasing. To do it in one pass is an achievement. The dull varnish is common and well known. The "Mike Plate" or "Modified Mike Plate" accentuates the contrast.

Figure 4:
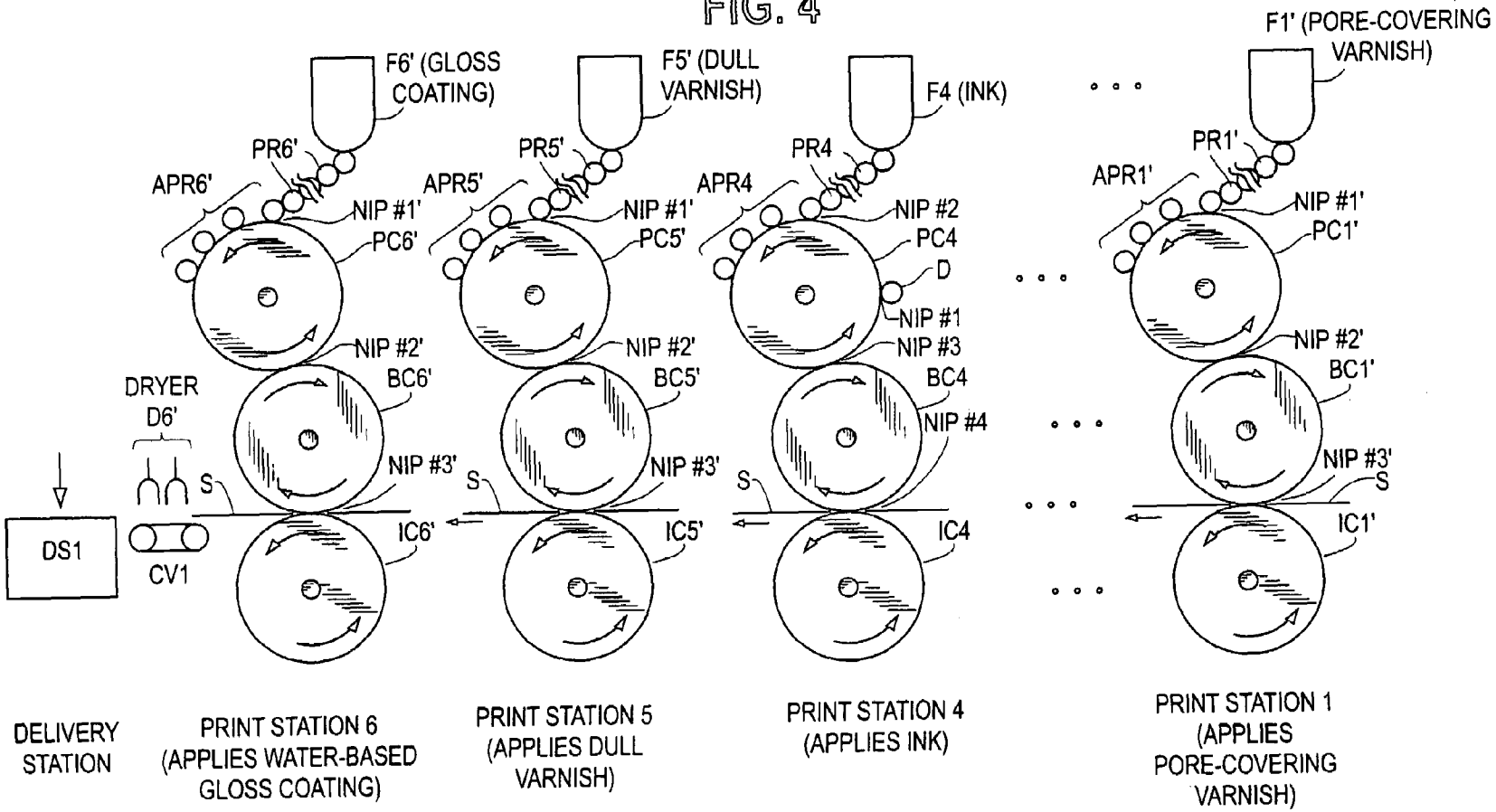
FIG. 4 shows a variation of the present invention similar to that of FIG. 3 except that the first print station applies a pore-covering oil-based varnish, which I have discovered can serve two functions. Namely, it seals the pores even when somewhat inexpensive paper or paperboard stock is used, and thus enhances the gloss intensity of the water-based over-print coating applied on print station 6. Additionally, it forms an undercoat for any ink, and thus improves the color quality of the ink applied thereover, even when relatively non-porous paper or paperboard is fed to the press.

If it is desired to apply both the dull varnish and glossy coating respectively on print stations 5 and 6 or a 6 station printing press, and only three colors of ink are acceptable, then this printing press could get the benefit of applying a pore-covering liquid on station 1. FIG. 4 shows how this is done where the liquid on station 1 is an oil-based litho varnish. Said varnish does not need a dryer between print stations 1 and 2, because that which is deposited thereon from the following print stations can wet-trap thereon.

As previously indicated, most litho printing presses do not now have enough space between stations 1 and 2 to accommodate a dryer which would adequately dry a water-based pore-covering liquid without reducing press speed to an undesired level. But if drying technology produces new drying technique(s) in the future where press slowdown is obviated, the broader aspect of the invention would include such a water-based pore-covering liquid applying station 1, and such an improved dryer between it and print station 2.

The FIG. 4 embodiment thus shows that there is a first print station which comprises a pore-covering oil-based varnish containing fountain F', pressure-applying rollers PR1' feeding the coating from the fountain F1' to the applicator rollers APR1' which in nip#1' apply the varnish to the "Mike Plate" or "Modified Mike Plate" carried on the surface of the printing plate cylinder PC1'. The cylinder PC1' then, through this "Mike Plate" applicator layer L1, applies the varnish in a nip #2 to the blanket on the blanket cylinder BC1', which transfers the varnish nip #3 to the sheets S passing between the blanket on the blanket cylinder BC1' and the impression cylinder IC1'.

Then the sheets are fed to a second and third print station not shown in FIG. 4 and then to a fourth print station shown in FIG. 4 comprising, as do station 2 and 3, a fountain which applies ink to pressure-applying rollers PR4 and applicator rollers APR4 in a nip #2 at the surface of the print cylinder PC4. A dampener D applies water to the surface of the cylinder PC4 in a nip #1. The print cylinder PC4 then delivers the ink in a nip #3 to the blanket on the blanket cylinder BC4 and the impression cylinder IC4.

Next, the sheets are moved to the dull oil-based litho varnish applying station 5. This station includes a dull oil-based litho varnish-containing fountain F5' which feeds the varnish through pressure rollers PR5' and applicator rollers APR5' to a nip #1' at the surface of the "Mike Plate" or the like on the cylinder PC5'. The varnish is then applied to the areas of the print cylinder PC5' which have the projecting portions of the applicator layer L1 of the "Mike Plate" or the like involved. The varnish there applied is carried to nip #2 between the print cylinder PC5' and the blanket cylinder BC5', which at a nip #3 delivers the varnish involved to the areas of the sheets passing between the blanket on the blanket cylinder and impression rollers BC5' and IC5'. The dull varnish is deposited in areas of the ink printed sheets which are adjacent to the ink printed areas which are to receive a glossy coating at print station 6.

The print station 6 thus has the same components as do the last print stations in FIGS. 2 and 3. Thus station 6 has a water-based gloss coating fountain F6', pressure-applying rollers PR6', applicator rollers APR6', "Mike Plate" of the like-carrying print cylinder PC6', blanket on the blanket cylinder BC6', and impression cylinder IC6'. The glossy coating is transferred between these various cylinders at nip number 1, 2, and 3 shown in FIG. 4. The dull and glossy coated surfaces of the sheets (passing) between the various print stations just described and then moved by conveyor CV1 under the glossy coating dryer D6' and then to the delivery station DS1 in the manner previously described.

As previously indicated, the pore-covering oil-based litho varnish, the inks, and the dull varnish are all high dyne level oil-based materials which keep out ingredients which make it difficult or impossible for any water-based coatings to stick to them. In other words, these presently available oil-based materials readily stick to each other but not to water-based materials. That is why presently a water-based pore-covering coating cannot be used on station 1 where adequate drying of a water-based pore-covering coating at desired press speeds does not yet exist. The presence of a wet underprint pore-covering coating causes the inks to undesirably spread and smudge. The pore-covering oil-based litho varnish must not be dull, and in this respect differs from the dull varnish applied on print station 5. Another difference is the dull varnish need not have the film-forming capability of the pore-covering and thus need not be able to bridge. Further, the dull varnish has the pore-covering varnish and three colors of ink to rest upon, so there should not be many or any pores it has to confront. However, both the pore-covering and the dull varnish, like the litho inks, must have a high dyne level which keeps out ingredients which would prevent overprint water-based coatings, like the high-solids paste-consistency glossy water-based coating applied on station 6, from adhering thereto.

Unlike the glossy water-based coating applied by print station 6 which is dried by the dyer D6', the litho inks are not dry in the delivery pile at the delivery station DS1. These litho inks are not dry in the delivery pile and do not fully dry for 12–36 hours after being removed from the delivery pile. The dried water-based glossy coating-applied at print station 6 permits the piles of stacked sheets removed from the delivery station DS1 to be further handled and processed in the printing plant, even though the ink underneath is still wet.

Finally, it should be understood that the scope of the broader claims is intended to cover the disclosed embodiments of the invention and the equivalents thereof.

I claim:

1. A method of using a printing press having a number of printing stations, said method comprising the steps of:

using one or more of said stations to deposit image-forming ink on paper or paperboard sheet or web substrates;

before depositing said image-forming ink on said substrates applying to said substrates an underprint, film-forming, pore-sealing material which substantially seals all pores in relatively porous substrates which are or are expected to receive said image-forming ink, and after applying said image-forming ink to the pore-sealed substrates feeding said substrates in the same pass through said printing press to a coating station which applies a selected, glossy, water-based overprint coating on all or selected portions of the image-forming ink to produce on the finished product at least 80–92 gloss as read by a 60 degree glossmeter.

2. In a method of using a printing press having a number of image-forming ink-applying stations which apply ink to paper or paperboard substrates, said method including the steps of using at least one of said stations located ahead of any and all ink-applying stations to apply an underprint, film-forming, pore-sealing material on said substrates which substantially seals all pores in the substrates which are to receive ink so that the ink does not substantially sink into the same, the improvement wherein:

said press is a litho press and there is a glossy coating-applying station after the last litho ink-applying station, said glossy coating-applying station applying in the same pass through the equipment involved a water-based glossy coating over at least portions of the previously applied litho ink, to increase the gloss intensity of the printed litho ink;

providing sufficient drying equipment so that the glossy coating is in a dry state when the inked substrate is delivered to a delivery station;

and advancing the substrate through the various printing and coating stations and delivering the dried glossy coated substrates to said delivery station.

3. The method of claim 2 wherein said underprint, film-forming, pore-sealing material is an oil-based litho varnish.

4. The method of claim 2 wherein there is provided an oil-based varnish-applying station after the ink-applying station or stations and ahead of the water-based glossy coating-applying station, said varnish-applying station applying a dull, oil-based litho varnish over parts of the substrates adjacent to the glossy coated portions thereof to provide a contrast between the glossy coated and dull varnished portions thereof.

5. The method of claim 2 wherein said underprint pore-sealing material, and any and all inks are high dyne level oil-based materials which readily stick to each other and permit an overprint water-based gloss coating to stick to them.

6. The method of claim 2 wherein the selected water-based glossy overprint coating produces 80–92 gloss when applied over wet litho ink.

7. The method of claim 2 wherein the oil-based litho varnish has a dyne level of at least 38.

8. The method of claim 2 wherein said underprint film-forming, pore-sealing material is a water-based coating.

9. The method of claim 8 wherein said water-based underprint film-forming, pore-sealing material has a dyne level of at least 38.

10. A method of reducing the paper or paperboard substrate costs to the owners of a printing press which applies image-forming ink on the print surface of said substrate, said method comprising the steps of:

providing a press with one or more printing stations;

purchasing from a paper or paperboard company sheets or webs of a relatively porous paper or paperboard substrate;

before feeding said substrate to an image-forming ink printing station on said press applying an underprint pore-sealing material to the print surface of said relatively porous paper or paperboard substrate purchased from said company to substantially eliminate the porosity thereof and so that little or no ink sinks into the pores thereof;

and then feeding such pore-sealed paper or paperboard substrate to each print station which applies said image-forming ink thereon;

wherein said underprint pore-sealing material enhances the gloss of a selected glossy water-based overprint coating applied over said image-forming ink on said substrate to at least 80–92 as read by a 60 degree glossmeter and in the same pass through the equipment involved, and feeding said substrates to a glossy coating applying station after said image-forming ink is applied so that said pore-sealing material will enhance the gloss of the coating applied at said glossy coating-applying station to at least 80–92 as read by a 60 degree glossmeter.

11. In a method of using a litho printing press having a number of stations each having a fountain or container for applying a liquid material to a series of pressure-applying rollers, then to an applicator roller for depositing said liquid from said rollers onto the outer surface of a rotating first cylinder which receives said liquid in a nip therebetween, and a second rotating cylinder which passes the substrate to be printed upon in a subsequent nip with a third rotating cylinder, said method including the steps of using at least one of said stations in front of the last-to-be used station of said press to apply ink, and using a station after the ink-applying stations to deposit an overprint high-solids water-based glossy coating fed from the associated fountain over the ink applied by a previous ink-applying station; and moving said high-solids water-based glossy coated substrate to a dryer after it leaves said coating station so that the high-solids water-based glossy coating is dried before the substrate is delivered to a delivery station, the improvement wherein said first rotating cylinder upon which said applicator roller feeds said water-based glossy coating has on the surface thereof a glossy material-receiving layer with projecting portions for receiving the glossy coating from said applicator roller, said glossy material having a relatively high solids content so that it withstands the pressure of said rollers to deliver a substantial quantity of said glossy material to said substrate.

12. The method of claim 11 with the additional step of using the first-to-be-used station of said printing press to deposit on the substrate an underprint pore-sealing material fed from the associated fountain, pressure-applying and applicator rollers, and from the periphery of various cylinders, said pore-sealing material substantially sealing all pores which receive ink and water-based overprint coating on the print surface of the relatively porous paper or paperboard substrates fed to said press so that the litho ink and the water-based overprint glossy coating do not substantially sink beneath the print surface.

13. The method of claim 11 wherein the resultant product is biodegradable.

14. The method of claim 11 wherein said water-based overprint glossy material-receiving layer of said first rotatable cylinder of the last-to-be-used station is part of a multi-layered flexible body including said outermost layer which is translucent or transparent, said outermost layer being secured to an innermost layer that provides the user with an outline showing cut lines where said outermost layer can be cut before the flexible body is attached to the surface of said first cylinder and when said flexible body is placed on a horizontal surface off press, a person is then able to cut said outermost layer following said cut lines so that said outermost layer has projecting portions left after the cut portions are stripped from the remaining portions of said outermost layer.

15. In a method of reducing the paper or paperboard costs to the owners of a printing press in the printing of image-forming ink on paper or paperboard substrates using such a press, said method including the steps of providing a press with one or more printing stations; purchasing from a paper or paperboard company sheets or webs of relatively porous paper or paperboard substrates; before feeding said substrates to an ink printing station on said printing press applying an underprint pore-sealing material to said relatively porous paper or paperboard substrates purchased from said company to substantially eliminate the porosity thereof; and then feeding such pore-sealed paper or paperboard substrates to said one or more printing stations which apply said ink; the improvement wherein said pore-sealing material is applied by a pore-sealing station including a first rotating cylinder having on its surface a layer with projecting portions which receive said pore-sealing material and apply the same directly, or by another cylinder, upon said paper or paperboard sheets or webs which will be subsequently imprinted with ink at an ink-printing station.

16. A method of reducing the paper or paperboard substrate costs to the owners of a printing press in the printing of image-forming ink on paper or paperboard substrates using such a press, said method comprising the steps of: providing a press with one or more printing stations; purchasing from a paper company sheets or webs of a relatively porous paper or paperboard substrate; before feeding said substrate to an image-forming ink printing station on said press applying an underprint pore-sealing material to said relatively porous paper or paperboard substrate purchased from said company to substantially eliminate the porosity thereof and so that the ink does not substantially sink into the pores; and then feeding such pore-sealed paper or paperboard substrates to said one or more printing stations which apply said image-forming ink; the improvement wherein said pore-sealing material is applied by at least one pore-sealing station, said at least one pore-sealing station including a first rotating cylinder having on its surface thereof a multi-layer flexible body, said flexible body including an outermost translucent or transparent layer which receives said pore-sealing material and applies the same directly, or by another rotating cylinder, upon a paper or paperboard substrate, said outermost layer being secured to an innermost layer that provides the user with an outline showing cut lines where said outermost layer can be cut before the flexible body is attached to the surface of said first cylinder, and when said flexible body is placed on a horizontal surface off-press, a person is then able to cut said outermost layer following said cut lines, so that said outermost layer will have pore-sealing material-receiving projecting portions left after the cut portions are stripped from said outermost layer.

17. A method of reducing the cost of paper or paperboard substrates to the owners of a printing press in the printing of image-forming ink on the print surfaces of paper or paperboard substrates comprising the steps of:

providing a printing press with at least three ink-printing stations;

before feeding the substrates involved to said ink printing stations of said press there is applied to said substrates a pore-sealing material which substantially eliminates any porosity thereof thereby enhancing the resulting print quality and the gloss of a selected water-based glossy overprint coating when applied thereto;

feeding said substrates to said ink printing stations; and then applying a selected overprint water-based glossy coating to said substrates after ink is applied thereto on said press whose gloss is enhanced by said pore-sealing material to achieve at least a 80–92 gloss as read by a 60 degree glossmeter applied to the finished product, and in the same pass of the substrates through the equipment involved.

18. The method of claim 17 wherein said underprint pore-sealing material and said selected water-based overprint glossy coating are each applied by a rotating cylinder having on the surface thereof projecting portions which apply the pore-sealing or glossy overprint water-based coating materials involved to another cylinder in turn contacting the substrate involved where a litho press is being used or directly to the substrate where a litho press is not applying the same.

19. The method of claim 17 wherein said pore-sealing material is applied only once to said substrates and is one which is substantially all solids.

20. The method of claim 17 where the dyne level of the pore-sealing sealing material and all inks thereon prior to the application of the glossy overprint coating is at least 38.

* * * * *